United States Patent [19]

Malafosse et al.

[11] Patent Number: 4,717,549

[45] Date of Patent: Jan. 5, 1988

[54] OXYGEN CHEMICAL GENERATION RESPIRATION APPARATUS

[75] Inventors: Jean Malafosse; Gérard Varlot; Michel Pierre, all of Chalon-sur-Saone, France

[73] Assignee: L'Air Liquide, Societe Anonyme pour l'Etude et l'Exploitation des Procedes Georges Claude, Paris, France

[21] Appl. No.: 599,681

[22] Filed: Apr. 12, 1984

[30] Foreign Application Priority Data

Apr. 12, 1983 [FR] France ..... 83 05922

[51] Int. Cl.[4] ..... A62B 7/08

[52] U.S. Cl. ..... 422/122; 422/173; 422/177; 422/171; 422/206; 128/202.26; 128/202.28; 128/205.28

[58] Field of Search ..... 422/122, 173, 177, 206, 422/211, 171; 423/581; 128/202.26, 202.28, 205.28

[56] References Cited

U.S. PATENT DOCUMENTS

| | | | |
|---|---|---|---|
| 2,679,844 | 6/1954 | Hamilton et al. | 128/202.26 |
| 3,403,981 | 10/1968 | Lemcke et al. | 128/202.26 |
| 3,764,266 | 10/1973 | Murakami | 422/211 X |
| 3,819,334 | 6/1974 | Yoshida et al. | 422/173 |
| 3,874,854 | 4/1975 | Hunter | 60/298 X |
| 3,949,053 | 4/1976 | Gentry et al. | 422/173 X |
| 4,193,966 | 3/1980 | Dowgul | 422/122 |
| 4,200,092 | 4/1980 | Warncke et al. | 128/202.26 |
| 4,256,698 | 3/1981 | Warncke | 422/122 |
| 4,277,443 | 7/1981 | Van Der Smissen et al. | 422/122 |
| 4,325,364 | 4/1982 | Evans | 128/202.26 X |
| 4,490,272 | 12/1984 | Malatosse et al. | 422/179 X |

FOREIGN PATENT DOCUMENTS

| | | |
|---|---|---|
| 0022645 | 1/1981 | European Pat. Off. . |
| 2442637 | 6/1980 | France . |
| 671107 | 4/1952 | United Kingdom . |

*Primary Examiner*—David L. Lacey

*Attorney, Agent, or Firm*—Browdy and Neimark

[57] ABSTRACT

An oxygen chemical generation respiration apparatus of the cartridge type intended to receive an absorbing mass in the form of pellets such as potassium superoxide pellets, is provided with a central connector (5) for intake of the gases to be purified, vertically extended as an intake conduit (5') to a clearance space (9) above the housing bottom at the level of a lower perforated wall (7) supporting the regenerating charge, this conduit coming out in the center of this wall to which it is fastened; the upper part (6) of the cartridge housing, on the output side of the gases to be treated, is provided with a series of radiators (11) parallel to the direction of circulation of the gas flows in the regenerating charge, fastened to the housing walls (12) and whose length is less than the spacing between the two walls (7) and (8).

6 Claims, 7 Drawing Figures

OXYGEN CHEMICAL GENERATION RESPIRATION APPARATUS

FIELD OF INVENTION

This invention relates to an oxygen chemical generation respiration apparatus of the cartridge type containing an absorbing mass in the form of pellets, such as potassium superoxide to which optionally an alkaline-earth metal or potassium oxide or hydroxide is added, in particular cartridges which work at a high kinetic level.

BACKGROUND

Devices of this type are generally designed to meet the respiration needs of a person operating at a given level of effort for a well defined or specified period. For each apparatus therefore, this design determination leads to seeking minimum weight of superoxide corresponding to a maximum rate of use, which implies the best correlation of various parameters, such as reactivity of the superoxide, its temperature behavior, the size and shape of the superoxide pellets and particularly the structure of the regenerating charge.

Oxygen chemical generation breathing devices are subject at times to intense regeneration conditions when the respiration level reaches an output above 35 liters per minute (and even 70 liters/minutes, for a few minutes for carbon dioxide contents between 4 and 5%). Under these conditions, the particles of solid reagents with a potassium superoxide base are the site of reactions of the superoxide with carbon dioxide and water vapor. These reactions which release oxygen are very exothermic, subjecting the reagent particles to very high temperatures that can reach 200° to 300° C.

It is known that the superoxide reacts more quickly with carbon dioxide than with water vapor, which corresponds to a more accelerated fixing of the $CO_2$, whereas pure potassium superoxide generates oxygen from water vapor by forming relatively fusible potassium hydroxides. Thus, when a bed of superperoxide particles for regeneration of respiration gases is subjected to the action of a gas corresponding to a high respiratory rate, it is found that the layer of the regeneration product at the upstream end of the device, quickly becomes carbonated and the particles retain their shape and mechanical properties, while downstream from this layer the regeneration particles receive a considerable amount of water and are quickly deformed and made deliquescent.

If this operation is continued, this degradation evolves to fusion of the particles, thus causing a partial collapse of the regenerating charge, with formation of a compact fused mass offering a very reduced reactive surface to the gas and, in addition, empty cavities of reagent which often constitute preferred channels taken by the gas to be regenerated and in which the carbon dioxide is treated very imperfectly. Although a considerable proporation of the reactive product still remains in the bed of regenerating particles, a rapid increase is observed in the carbon dioxide content of the effluent gas corresponding to a great reduction in the overall reactivity of the bed; this reduction of the level of purification of the gas is often accompanied by a great increase in the pressure drop of the particle bed. Consequently, there is a poor use of the superperoxide which does not achieve its reactive potential.

Efforts have been made to mitigate this drawback by giving the cartridge such a structure that the gas passes through a small thickness of the superoxide at a slow speed, or by dividing the charge nto small fractions by numerous metal partitions that come in contact with the wall. These efforts led to complex structures in which the weight of the nonreactive material was relatively great; their cost is high and filling cartridges with them is rather clumsy and poorly suited to automation.

Recently, a means was proposed making it possible to eliminate the excessive increase in the pressure drops of the potassium superoxide during intense regeneration conditions. According to U.S. patent application Ser. No. 460,542 now U.S. Pat. No. 4,490,272 a certain proportion of alkaline-earth oxide in the powder state is incorporated in the potassium superoxide before granulation or pelleting; degradation of the particles caused by water vapor is slowed down. Calcium oxide is particularly effective in obtaining this result. However, this addition of lime has an impact on the amount of generable potential oxygen, the latter being limited because it dilutes the superoxide.

This means is not fully satisfactory when it is desired to make relatively thick beds of reactive mixtures of as thick as about twenty centimeters, which work at a high kinetic level, with an extended regeneration period and practically total use of the reactive potential of the solid.

SUMMARY

An effort has been made to find devices making it possible to treat gas mixtures corresponding to high respiratory levels for a so-called great period, i.e. greater than 90 minutes, and with practically complete use of the reactive potential of the generating charge.

According to the invention, a metal cartridge has been found for an oxygen chemical generation respiration apparatus, which works at high respiratory levels, and is provided with internal arrangements which, by promoting the partial outward elimination of the heat that is released, leads to optimal use of thick beds of pure potassium superoxide or mixtures of potassium superoxide optimally containing some calcium oxide.

According to one of these internal arrangements of this respiration, apparatus having a vertical circulation of the gases, including a housing comprising an open top and a closed bottom, coaxial connectors for intake and evacuation of the gases are concentrically on the top of the housing, and a central intake connector for the gases to be purified being extended as a vertical conduit, open at its base, to a clearance space between the housing bottom and the lower perforated wall of the cartridge which supports the regenerating charge, this intake conduit coming out in the center of this perforated wall to which is is attached such as by welding, stamping etc.

The gases to be purified circulate upwardly in the intake conduit, then are distributed in the clearance space of the housing bottom before going through the perforated wall supporting the regenerating charge and circulating upwardly through the charge, the regenerated gases then going through the upper perforated wall of the regenerating cartridge, and then escaping through the evacuation connector.

The internal arrangement consisting of the central tube for intake of the gases to be purified is advantageously selected from heat-conductive materials such as metals, e.g. copper and brass.

According to another internal arrangement of a cartridge in which circulation of the gases to be regenerated is upward, the upper part of the cartridge housing is provided with a series of radiators parallel to the direction of circulation of the gas flows in the regenerating charge, fastened to the walls of the housing and the length of which is less than the height of the regenerating charge. It has been found that the length of the radiators is advantageously between half and a third of the spacing between the two perforated walls supporting and holding the regenerating charge. These internal arrangements placed in the upper part of the regenerating charge, on the output side of the gas to be treated, are made of materials that are good heat conductors, i.e. have high heat conductivity, such as copper and brass, for example from sheets 0.5 to 1 mm thick.

Although simple, economic and easily embodied solutions such as straight tubes, smooth sheets, give excellent results, it is also possible to use more elaborate structures such as fins, corrugated sheets, etc.

When the internal arrangement of the cartridge housing is limited to radiators, they can comprise an open top and bottom with a coaxial intake connector placed on the bottom of the housing and a coaxial evacuation connector placed on the top of the housing.

An advantageous embodiment consists of two internal arrangements of the cartridge, namely the vertical central conduit for introduction of the gases to be purified coming out in the clearance space of the housing bottom, and placing of a series of radiators parallel to the direction of circulation of the gas flows in the regenerating charge fastened to the walls of the housing and the length of which is less than the height of the charge, preferably between half and one third of the spacing between the two perforated walls delimiting the height of the regenerative charge. In this type of device, the cartridge housing comprises an open top in which coaxial connectors for intake and evacuation of the gases are placed.

BRIEF DESCRIPTION OF DRAWING

The invention will be illustrated with the figures and the examples described below.

DETAILED DESCRIPTION OF EMBODIMENTS

Figure 1:
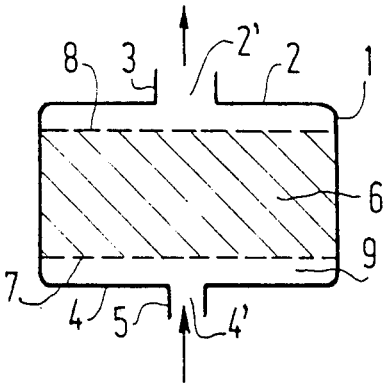
FIG. 1 represents a device with open top and bottom without the internal arrangement in a sectional view.

FIG. 1 shows a metal housing body (1) on which is provided, such as by welding at its upper end, a top (2) with a central opening (2') having a connector 3 extending therefrom, and which can be connected to a pipe of the regenerated gases, not shown. The opening 2 and the connector 3 are centrally located, as shown. At the lower end of the housing, is welded or otherwise provided a bottom (4) with a central opening (4') from which extends an intake connector (5) or pipe for intake of the gas to be regenerated.

On the inside of the housing body is the regeneration cartridge (6) which comprises a lower perforated wall (7) and an upper perforated wall (8), between which the regenerative charge is housed. Between bottom (4) and perforated wall (7) is a clearance space (9) of the housing bottom.

In this regeneration apparatus, the gas to be regenerated is introduced by the lower pipe through the connector 5 and opening 4' goes upward through the regenerating charge within the cartridge 6 after regeneration, is evacuated through the opening 2' and connector 3 by the upper pipe.

Figure 2:
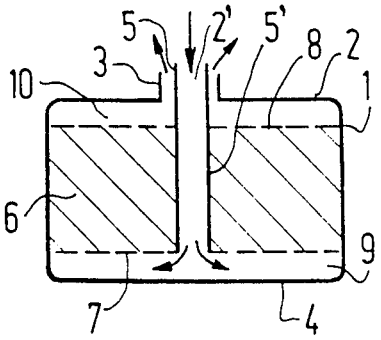
FIG. 2 represents a sectional view of a regeneration apparatus with a central tube for intake of the gases to be purified, and an open top.

FIG. 2 shows housing body (1) to which are welded, at its upper end, a top (2) with a central opening (2'), the lower end of which has a closed bottom (4). On the top (2) are coaxially welded a connector (5) for intake of the gas to be purified and a connector (3) for evacuation of the regenerated gas; the open central connector extends through the cartridge as an intake conduit (5') coming out in the center of the lower perforated wall (7) of the cartridge 6.

In this regeneration device, the gases to be purified are introduced in the intake connector (5) and circulate vertically downward through intake conduit (5'), are distributed in the clearance space (9) of the housing bottom, pass upwardly through the lower perforated wall 7 and the bed of potassium oxide, escape through the upper perforated wall (8) of the cartridge 6, circulate in the upper clearance space (10), and then leave the device through the coaxial evacuation connector (3) in the direction of the regenerated gas pipe, not shown.

Figure 3:
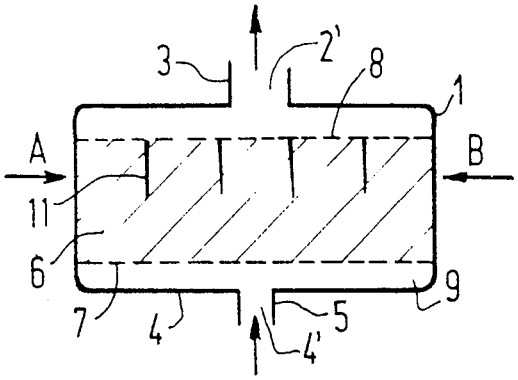
FIGS. 3 and 3*a* show views in section of a cartridge housing with open top and bottom provided with radiators.
Figure 3A:
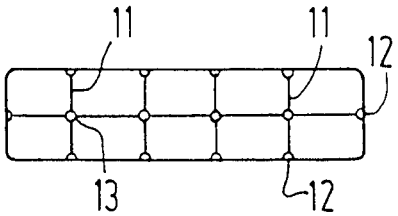

FIGS. 3 and 3*a* show a housing of the type of FIG. 1, further comprising an internal arrangement of a series of parallel radiators (11) suitably fastened such as by weldings (12) onto the side walls of the housing. The section along line AB shows in FIG. 3*a* the arrangement of the radiators and their points of insertion (12) on the housing walls and the points of contact (13) between them, particularly for fin-shaped radiators.

Figure 4:
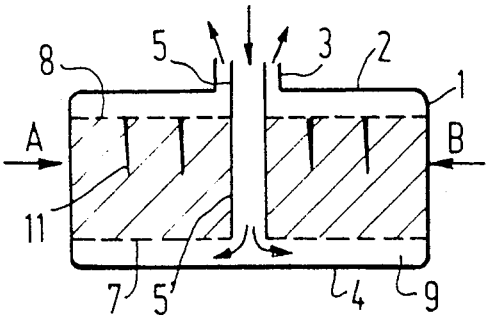
FIGS. 4 and 4*a* are views in section of the association of two internal arrangements; central intake tube and radiators.
Figure 4A:
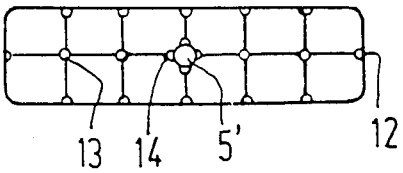

FIG. 4 shows a housing of the type of FIG. 2 further comprising an internal arrangement consisting of a series of parallel radiators (11) fastened as described above in relation to FIG. 3*a*. And, in FIG. 4*a*, along section AB, can be seen the distribution of the radiators, their points of fastening (12) on the housing walls and points of contact (13) between them, and their points of fastening (14) to the central in conduit (5') for intake of the gases to be purified.

Figure 5:
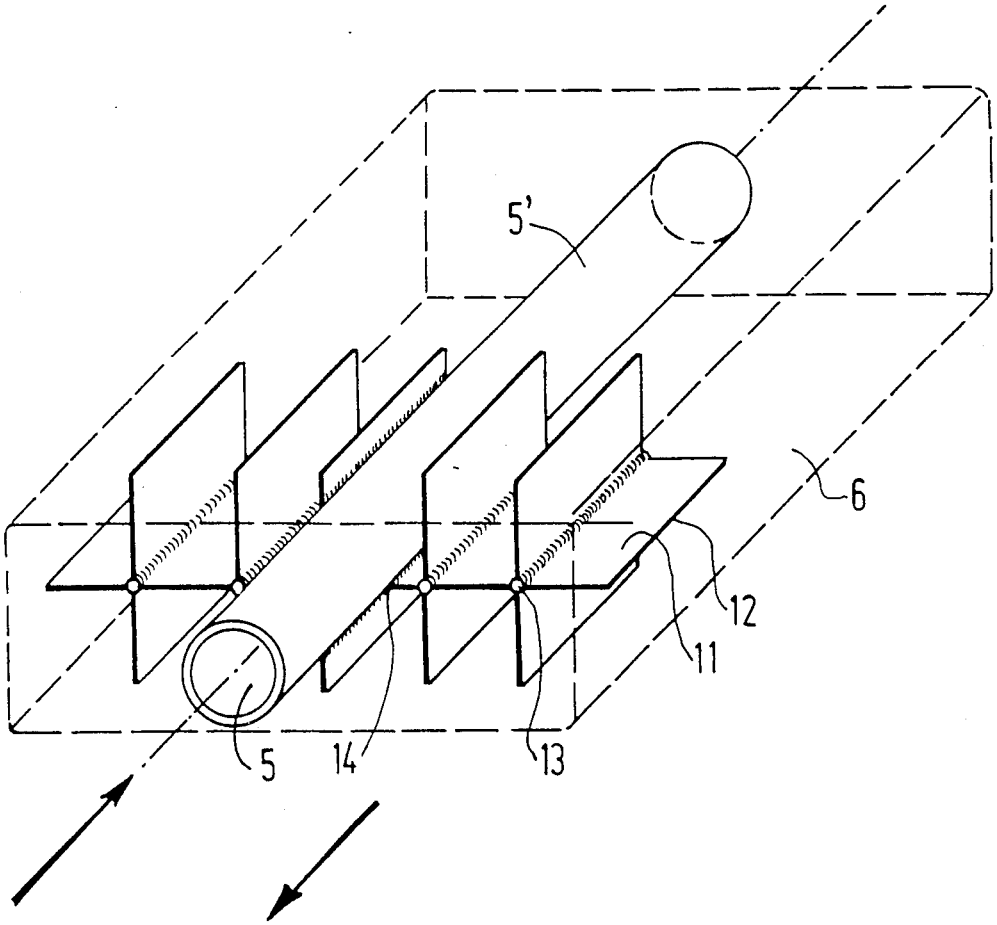
FIG. 5 is a view in the case where the radiators are fins.

FIG. 5 shows a view of the housing of FIG. 4 with representation of the directions of the gases to be purified and after regeneration in the case of association of the central intake conduit and finned radiator, with the gas outlet at the upper part of the cartridge placed in the housing.

To evaluate the improvement in performance of oxygen chemical generation respiration apparatus, the device succinctly described below, is used experimentally:

It comprises a pulsed gas generator with 20 pulsations per minute and an average delivery of 35 liters per minute at 20° C. This generator receives at each pulsation a constant volume of carbon dioxide corresponding to an average delivery of 1.57 liter/minute (4.5% of 35 l/min). This gas, brought to 37° C. and saturated with water vapor at this temperature, is sent over a potassium superoxide bed, then collected in a respiratory sac and aspirated in the generator where it is brought back to the starting value of carbon dioxide and water vapor. The unit thus functions as a semi-closed circuit; the gas generator rejects into the atmosphere a volume of purified gas equivalent to the volume of carbon dioxide introduced; a calibrated valve on the respiratory sac eliminates the excess oxygen possibly supplied by the respiratory charge of potassium superoxide. Oxygen and carbon dioxide analyzers continuously report the composition of the purified gas; the variation in the pressure drop if the unit is also measured; superoxide bed—respiratory sac, at expiration and inspiration.

The endurance of the cartridge is the time at the end of which one of the following limits is reached: the $CO_2$ content of the purified gas is greater than 1.5%; the increase in the pressure drop at expiration is greater than 5 millibars (this measures the increase in pressure drop of the superoxide bed due to partial clogging); the variation in pressure drop at inspiration increases abruptly and the respiratory sac is flat (this indicates a zero or greatly reduced oxygen generation which no longer meets the respiratory need).

Under the test conditions described above, the following is a description of tests performed.

EXAMPLES 1 TO 4

A potassium superoxide bed was used having a rectangular section of 162 $cm^2$ through which the gas to be purified passed upwardly at expiration. The charge used, weighing 1600 g, consisted of biconcave pellets 9 mm in diameter and 4.5 mm thick made from a mixture with a superoxide base containing 70% $KO_2$. 10% CaO, 15% KOH and 0.135% $Cu^{++}$ in oxychloride form.

With the device of FIG. 1, without the internal separating arrangement, the $CO_2$ content of the purified gas exceeded 1.5% after 78 minutes of operation.

Using the device of FIG. 2 with a central intake tube, this limit was reached in 88 minutes.

With the radiators shown diagrammatically in FIG. 3, this $CO_2$ content of the effluent was reached only after 97 minutes of operation.

With the device according to FIG. 4, combining the central intake tube and the radiators, the endurance measured in regard to $CO_2$ was then 102 minutes.

In all cases, the increase in pressure drop remained well below the established limit.

EXAMPLE 5

1800 g of potassium superoxide comprising 73.3% $KO_2$, 8% CaO and 10 ppm $Cu^{++}$ were placed in a cartridge as shown in FIG. 1 having a cross sectional area of 162 $cm^2$. The operation was under the same test conditions as for the preceding examples, but, in addition, the cartridge was placed in a housing similar to that used in the commercial type respiratory apparatus.

It was found that the pressure drop at expiration remained practically constant, after an initial stabilization period lasting a few minutes after the beginning of the operation. The carbon dioxide content of the effluent gas went through a maximum of 0.8% at the 72nd minute, then rapidly decreased and was only 0.2% at the 97th minute. Oxygen generation stopped after 97 minutes of operation, the respiratory sac was then flat and the pressure drop at inspiration increased abruptly.

While the invention has been described in detail above, it is to be understood that this detailed description is by way of example only, and the protection granted is to be limited only within the spirit of the invention and the scope of the following claims.

What is claimed is:

1. An oxygen chemical generation respiration device, comprising a housing having at least one closed side wall, a closed bottom wall connected to said at least one side wall, and a top wall having centrally disposed opening therein, said at least one side wall being connected to said bottom wall and top wall to make said housing gas impervious except for the opening in said top wall;

a pair of perforated plates within said housing and extending thereacross generally parallel to said top and bottom walls, so as to define within said housing an upper zone lying between said top wall and an upper of said perforated plates, a bottom zone lying between said bottom wall and a lower of said perforated plates, and a middle zone lying between said upper and lower perforated plates, said middle zone defining a space for receiving an adsorbing regenerating charge in the form of pellets to form a thick bed thereof supported by said perforated plates;

a gas intake tube, formed of heat conductive material, passing through and coaxial with the opening in said top wall and extending downwardly through the upper zone, through the upper perforated plate, through the middle zone and through said bottom perforated plate to which said gas intake tube is connected, said tube thereby defining means for passing gases external of said housing into the bottom zone through said tube whereupon the gases then pass upwardly through said lower perforated plate, through the middle zone capable of containing an adsorbing regenerating charge in the form of pellets, through said upper perforated plate and into the upper zone from whence the gases escape through the opening in the top wall; and a series of light weight fins, formed of material having high heat conductivity, disposed in the middle zone immediately beneath said upper perforated plate and extending generally perpendicular to said upper perforated plate, said fins being fastened to one another, to said intake tube and to said at least one side wall of said housing, and each fin having a height which is between ⅓ and ½ the height of the middle zone.

2. A device according to claim 1 wherein said fins are formed of copper sheets having a thickness of 0.5–1 mm.

3. A device according to claim 1, wherein said fins are formed of brass sheets having a thickness of 0.5–1 mm.

4. An oxygen chemical generation respiration device, comprising a housing having at least one closed side wall, a closed bottom wall connected to said at least one side wall, and a top wall having centrally disposed opening therein, said at least one side wall being connected to said bottom wall and top wall to make said housing gas impervious except for the opening in said top wall;

a pair of perforated plates within said housing and extending thereacross generally parallel to said top and bottom walls, so as to define within said housing an upper zone lying between said top wall and an upper of said perforated plates, a bottom zone lying between said bottom wall and a lower of said perforated plates, and a middle zone lying between said upper and lower perforated plates, said middle zone containing an adsorbing regenerating charge of pellets in the form of a thick bed supported by said perforated plates;

a gas intake tube, formed of heat conductive material, passing through and coaxial with the opening in said top wall and extending downwardly through the upper zone, through the upper perforated plate, through the middle zone containing said thick bed of pellets of adsorbing regenerating charge, and through said bottom perforated plate to which said gas intake tube is connected, said tube thereby defining means for passing gases external of said housing into the bottom zone through said tube whereupon the gases then pass upwardly through said lower perforated plate, through said pellets of said adsorbing regenerating charge, through said upper perforated plate and into the upper zone from whence the gases escape through the opening in the top wall; and a series of light weight radiator fins, formed of a heat conductive metal, disposed in the middle zone immediately beneath said upper perforated plate and extending generally perpendicular to said upper perforated plate, said radiator fins being fastened to one another, to said intake tube and to said at least one side wall of said housing, and each radiator fin having a height which is substantially less than the height of the middle zone.

5. A device according to claim 4, wherein said fins are formed of copper sheets having a thickness of 0.5–1 mm.

6. A device according to claim 4, wherein said fins are formed of brass sheets having a thickness of 0.5–1 mm.

* * * * *